United States Patent [19]

Ichikawa

[11] Patent Number: 4,764,910

[45] Date of Patent: Aug. 16, 1988

[54] ELECTRONIC TIMEPIECE

[75] Inventor: Shingo Ichikawa, Sayama, Japan

[73] Assignee: Citizen Watch Co., Ltd., Tokyo, Japan

[21] Appl. No.: 836,355

[22] Filed: Mar. 5, 1986

[30] Foreign Application Priority Data

| | | | |
|---|---|---|---|
| Mar. 8, 1985 | [JP] | Japan | 60-46103 |
| Jul. 2, 1985 | [JP] | Japan | 60-145112 |
| Sep. 27, 1985 | [JP] | Japan | 60-214113 |

[51] Int. Cl.[4] ..... G04C 17/00

[52] U.S. Cl. ..... 368/69; 368/185; 368/187

[58] Field of Search ..... 368/69, 70, 184, 185, 368/187, 188, 189

[56] References Cited

U.S. PATENT DOCUMENTS

| | | | |
|---|---|---|---|
| 4,468,131 | 8/1984 | Bui et al. | 368/69 |
| 4,671,671 | 6/1987 | Suetaka | 368/69 |

*Primary Examiner*—Bernard Roskoski

*Attorney, Agent, or Firm*—Townsend & Townsend

[57] ABSTRACT

An electronic timepiece includes a plurality of light-receiving elements arranged to receive external light, a light-receiving condition discriminator for discriminating a light-receiving condition of each light-receiving element, and a circuit to be controlled in response to an output signal from the light-receiving condition discriminator. The light-receiving condition discriminator discriminates that the light-receiving condition of a central one of three light-receiving elements among the plurality of light-receiving elements is different from those of end light-receiving elements, and thereupon generates an output signal.

12 Claims, 12 Drawing Sheets

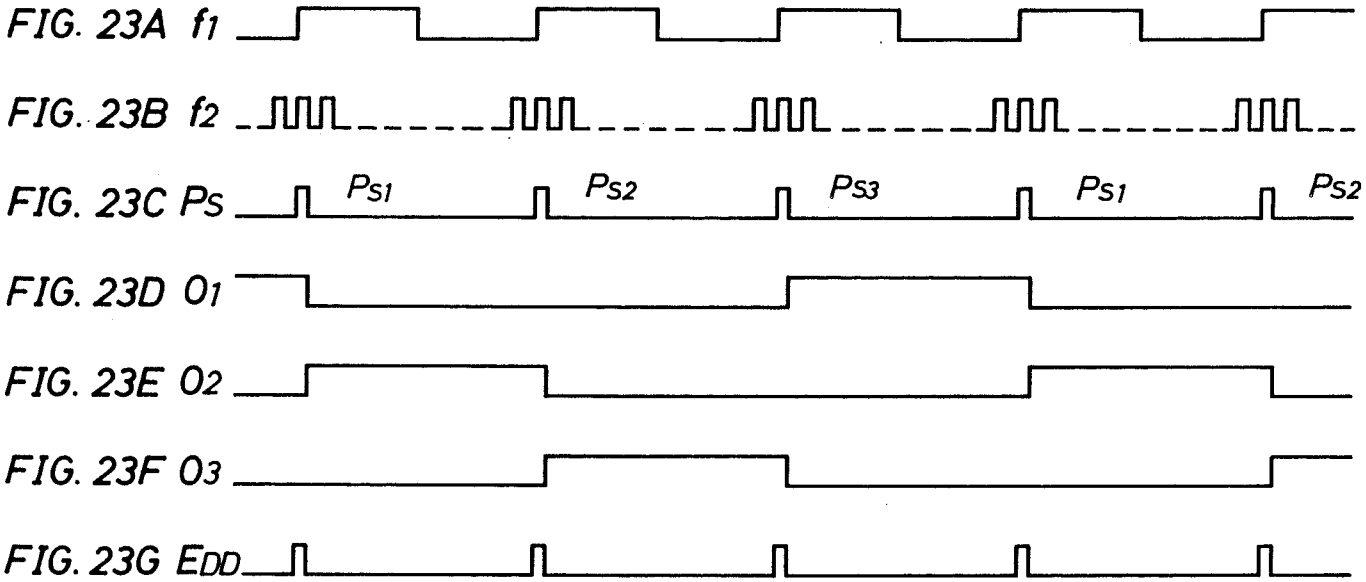
FIG. 23A f1
FIG. 23B f2
FIG. 23C PS
PS1
PS2
PS3
PS1
PS2
FIG. 23D O1
FIG. 23E O2
FIG. 23F O3
FIG. 23G EDD

ELECTRONIC TIMEPIECE

BACKGROUND OF THE INVENTION

1. Field of the Invention

The present invention relates to an electronic timepiece using a plurality of light-receiving elements for receiving signal inputs.

2. Description of the Prior Art

A typical signal input device for a conventional electronic timepiece includes an external operation member such as a crown or button, and a switch controlled by the external operation member. Japanese Patent Publication No. 56-23114 describes another conventional signal input device wherein an external operation member extending through the watch case is not used to provide a waterproof mechanism, a light-receiving element is arranged inside the watch case, and light incident on the light-receiving element is externally controlled.

Since the conventional signal input device with a light-receiving element does not use an external operation member extending through the watch case, reliability of the waterproof effect can be improved, and a low-profile construction can be achieved. In addition, the number of components is decreased, making it low cost, along with many other advantages provided by this signal input device. However, since natural light is used as an input means, malfunction in the normal operation state causes some problems. In order to prevent such malfunction, complex input conditions must be satisfied. However, a signal input device of this type becomes difficult to operate if such complex input conditions ae set to completely prevent malfunction.

SUMMARY OF THE INVENTION

It is an object of the present invention to provide an electronic timepiece with a signal input device, wherein a good waterproof effect is maintained, complex input conditions are not required, and malfunction can be eliminated.

It is another object of the present invention to provide a long-life electronic timepiece which uses a solar cell, i.e., an energy source as a light-receiving element, requires only a small number of components, and does not require battery change.

It is still another object of the present invention to provide an electronic timepiece with a signal input device, wherein complex input conditions are not required, power consumption is small, and malfunction is completely eliminated.

According to an aspect of the present invention, there is provided a signal input device in an electronic timepiece, wherein a plurality of light-receiving elements are arranged in the electronic timepiece, and a light-receiving condition discriminator is arranged to discriminate a light input condition of the light-receiving elements and detects a light-receiving condition different from that of a normal operating state of the electronic timepiece to cause switching, so that the signal input device has good operability and is free from malfunction.

By employing the signal input device of the present invention, an external operation member or the like can be eliminated from the electronic timepiece. Therefore, a compact, low-profile, waterproof electronic timepiece can be provided.

The above and other objects, features and advantages of the present invention will be apparent from the following detailed description taken in conjunction with the accompanying drawings.

BRIEF DESCRIPTION OF THE DRAWINGS

FIGS. 23A–23G are timing charts for explaining the operation of the electronic timepiece shown in FIG. 20.

DETAILED DESCRIPTION OF THE PREFERRED EMBODIMENTS

Electronic timepieces according to preferred embodiments will be described with reference to the accompanying drawings wherein corresponding signal input devices are applied to time correction.

Figure 1:
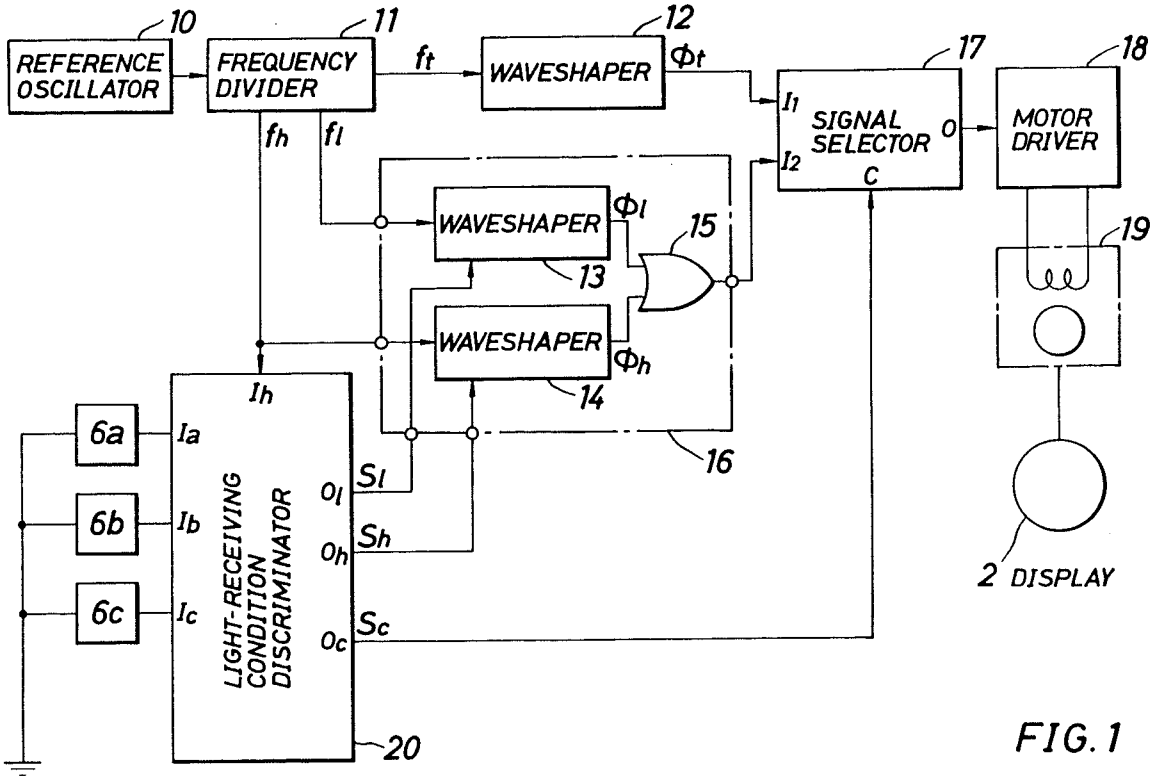
FIG. 1 is a system block diagram of an electronic timepiece according to an embodiment of the present invention.
Figure 2:
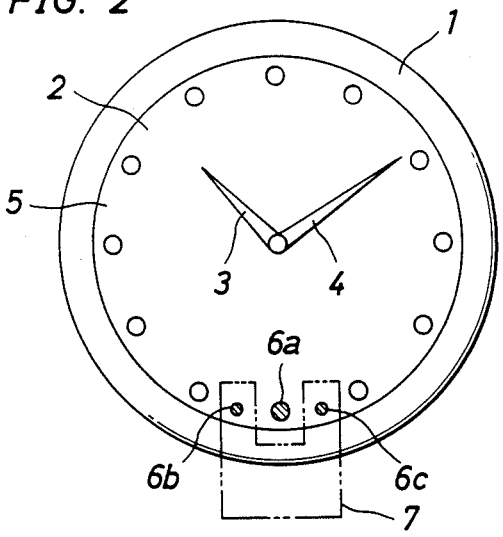
FIG. 2 is a front view showing an electronic timepiece according to the present invention.

FIG. 1 is a system block diagram of an electronic timepiece according to a first embodiment of the present invention, and FIG. 2 is a front view showing the outer appearance of the electronic timepiece.

As shown in FIG. 2, the electronic timepiece includes a case 1 and an analog timer display 2. The analog timer display 2 consists of an "hour" hand 3, a "minute" hand 4, and a face 5. Light-receiving elements 6a, 6b, and 6c are respectively arranged in small holes formed in part of the face 5 at equal angular intervals. The central light-receiving element 6a serves as one for hour digits.

Figure 3:
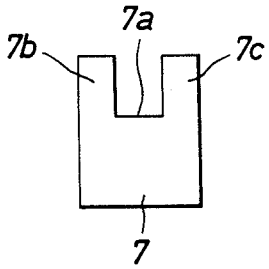
FIG. 3 is a plan view of an operation jig used for inputting a signal to the electonic timepiece shown in FIG. 2.

FIG. 3 shows an operation jig 7 used for externally controlling the signal input device. The jig 7 has two light-shielding portions 7b and 7c at two sides of a light-transmitting portion 7a.

When the operation jig 7 is set as indicated by the alternate long and short dashed line in FIG. 2, a signal is input, in a manner to be described later, to the central light-receiving element 6a, whose light-receiving condition is different from those of the light-receiving elements 6b and 6c.

FIG. 1 is a block diagram of the electronic timepiece. The electronic timepiece includes a reference oscillator 10 and a frequency divider 11. The frequency divider 11 generates a signal ft of a 20-second period, a 2-Hz signal fl, and a 64-Hz signal fh. Waveshapers 12, 13 and 14 receive the signals ft, fl, and fh and generate a time count signal $\phi$t, a low-speed correction signal $\phi$l, and a high-speed correction signal $\phi$h. The waveshapers 13 and 14 and an OR gate 15 constitute a correction signal generator 16.

A signal selector 17 outputs the time count signal $\phi$t, the low-speed correction signal $\phi$l, or the high-speed correction signal $\phi$h. The electronic timepiece further includes a motor driver 18, a pulse motor 19 and the analog timer display 2 (FIG. 2). A light-receiving condition discriminator 20 discriminates light-receiving conditions of the three light-receiving elements 6a, 6b and 6c and outputs a selection control signal Sc, a low-speed correction control signal Sl, and a high-speed correction control signal Sh. These control signals are supplied to a correction signal generator 16 and a signal selector 17. Thus, the generator 16 and the selector 17 are controlled by the discriminator 20.

Figure 4:
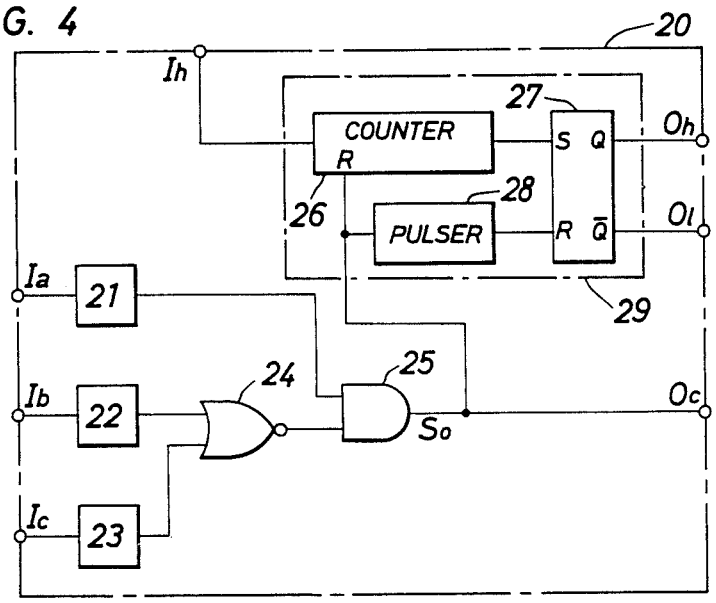
FIG. 4 is a block diagram of a light-receiving condition discriminator in the electronic timepiece of FIG. 1.

FIG. 4 is a block diagram showing the arrangement of the light-receiving condition discriminator 20 of FIG. 1. The discriminator 20 comprises input terminals Ia, Ib, and Ic of the three light-receiving elements 6a, 6b, and 6c, an input terminal Ih for receiving the signal fh from the frequency divider 11, and output terminals Oc, Ol, and Oh for the selection control signal Sc, the low-speed correction control signal Sl, and the high-speed correction control signal Sh, respectively.

Light-receiving signal generators 21, 22 and 23 receive signals from the elements 6a, 6b, and 6c and generate ON/OFF signals in accordance with a predetermined level.

A NOR gate 24 generates a signal of logic "1" only when the signals from the light-receiving signal generators 22 and 23 are both OFF. An AND gate 25 is normally disabled and generates a signal of logic "0". The AND gate 25 generates a signal S0 of logic "1" only when both the signal from the light-receiving signal generator 21 and the output signal from the NOR gate 24 are set at logic "1". A counter 26 receives the signal fh from the input terminal Ih. An RS flip-flop (to be referred to as an RS·FF hereinafter) 27 is adapted to be set in response to the output signal from the counter 26. The counter 26, the RS·FF 27 and a pulser 28 constitute a timer circuit 29.

The operation of the light-receiving condition control circuit shown in FIG. 4 will be described. Assume that the light-receiving conditions of the light-receiving elements 6a, 6b, and 6c are those shown in FIG. 2. In other words, light is incident on the central light-receiving element 6a but not on the end light-receiving elements 6b and 6c. This condition is unlikely to exist during the normal timepiece operation while a user has the timepiece on his wrist. In normal timepiece operation, light is incident on all of the light-receiving elements, or light is incident on none of them. Even if the timepiece is partially covered with the sleeve of a shirt, usually only the central light-receiving element 6a and one of the light-receiving elements 6b and 6c are covered. Therefore, the condition of the presence of incident light only on the light-receiving element 6a cannot be satisfied without using the operation jig shown in FIG. 3.

Referring to FIG. 4, when the operation jig 7 is not used, the condition signal S0 is not generated by the AND gate 25, and the AND gate 25 is held at logic "0". The selection control signal Sc does not appear at the output terminal Oc. In addition, the counter 26 is reset and the timer circuit 29 is disabled (when a reset terminal R of the counter 26 is set at logic "0", it is reset, and its reset mode is cancelled in response to the condition signal S0 of logic "1" supplied thereto).

When the operation jig 7 is set in the state indicated by the alternate long and short dashed line in FIG. 2, light is incident on only the light-receiving element 6a. In this state, the output from the light-receiving signal generator 21 is enabled, and outputs from the light-receiving signal generators 22 and 23 are disabled.

An output from the NOR gate 24 goes to logic "1", and then the condition signal S0 of logic "1" is generated by the AND gate 25. The condition signal S0 appears as the selection control signal Sc at the output terminal Oc and is supplied to the timer circuit 29 to cancel the resetting of the counter 26. At the same time, the signal Sc serves to reset the RS·FF 27 through the pulser 28. As a result, the output from an output terminal $\overline{Q}$ of the RS·FF 27 appears as the low-speed correction signal Sl at the output terminal Ol. At the same time, the counter 26 receives the signal fh from the input terminal Ih and starts counting. When a predetermined timer time (10 seconds in this embodiment) has elapsed, the counter 26 generates the output signal to set the RS·FF 27. The low-speed correction signal Sl stops appearing at the output terminal Ol, and the high-speed correction signal Sh appears at the output terminal Oh, in place of the low-speed correction signal Sl.

When the operation jig 7 is set on the light-receiving elements, the light-receiving condition discriminator 20 continuously generates the selection control signal Sc at the output terminal Oc while the operation jig 7 is being set. At the same time, for 10 seconds after the operation jig 7 is set, the low-speed correction control signal Sl appears at the output terminal Ol. After 10 seconds, the high-speed correction control signal Sh appears at the output terminal Oh. This series of operations is repeated whenever the operation jig 7 is set.

A time correction operation of the electronic timepiece through the use of the light-receiving condition discriminator 20 will be described with reference to FIG. 1.

In a normal operation state wherein the operation jig 7 is not set on the light-receiving elements, the selection control signal Sc does not appear at the output terminal Oc of the light-receiving condition discriminator 20. The signal selector 17 selects the time count signal $\phi$t from an input terminal I1 thereof to an output terminal O thereof. The motor driver 18 receives the time count signal $\phi t$ and drives the pulse motor 19 to operate the analog timer display 2 for every 20-second period.

The time correction operation in this state is as follows. When the user sets the operation jig 7 on the light-receiving elements 6a, 6b, and 6c in the manner as described above, the light-receiving conditon discriminator 20 generates the selection control signal Sc upon generation of the condition signal S0, and the RS·FF 28 is reset to generate the low-speed correction control signal Sl.

When the selection control signal Sc is supplied to the signal selector 17, the selection state thereof is changed over from the input terminal I1 to I2, and time counting in response to the time count signal $\phi t$ is stopped. The low-speed correction control signal Sl is supplied to the correction signal generator 16, and the waveshaper 13 is enabled and generates the low-speed correction signal $\phi l$. This signal $\phi l$ is supplied to the motor driver 18 through the OR gate 15 and the signal selector 17. The analog timer display 2 is corrected at a speed corresponding to the frequency (2 Hz) of the low-speed correction signal $\phi l$. As described above, the light-receiving condition discriminator 20 generates the high-speed correction control signal Sh in place of the low-speed correction control signal Sl 10 seconds after the operation of the timer circuit 29. The output from the correction signal generator 16 disables the waveshaper 13 and then enables the waveshaper 14, thereby generating the high-speed correction signal $\phi h$. The high-speed correction signal $\phi h$ is then supplied to the motor driver 18 through the OR gate 15 and the signal selector 17. The analog timer display 2 is then corrected at a high speed corresponding to the frequency (64 Hz) of the high-speed correction signal $\phi h$.

This correction operation is stopped upon removal of the operation jig 7 from the light-receiving elements. In other words, the condition signal S0 from the light-receiving condition discriminator 0 is disabled, and the selection control signal Sc is disabled accordingly. Therefore, the initial selection state (i.e, the input terminal I1) of the signal selector 17 is restored, and time counting is restarted in response to the time count signal $\phi t$.

The time correction technique in the time correction device of the present invention is performed in the following manner. When a correction amount is small, only the low-speed correction signal $\phi l$ is used. However, when a correction amount is large, the low- and high-speed correction signals $\phi l$ and $\phi h$ are used to bring the time near a correct target time. Subsequently, the operation jig 7 is temporarily removed from the light-receiving elements, and is then set again. At this time, the low-speed correction signal $\phi l$ is used to correct the current time to the target time.

Figure 5:
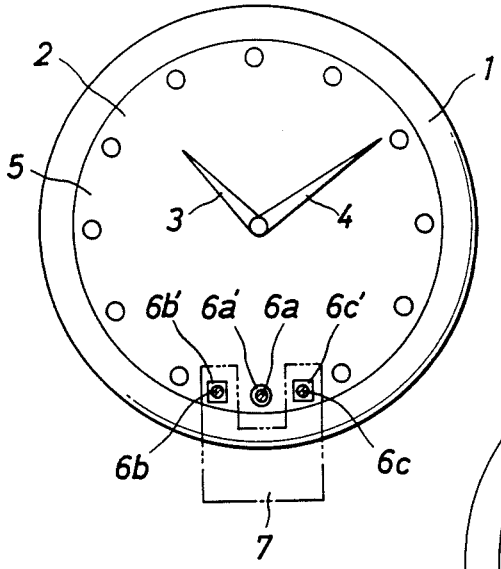
FIGS. 5, 6 and 7 are front views showing other electronic timepieces according to the present invention.

FIG. 5 is a front view showing another electronic timepiece according to the present invention. This electronic timepiece is different from that of FIG. 2 in that identification marks 6a', 6b', and 6c' are formed on light-receiving elements 6a, 6b, and 6c to identify a light-receiving condition of the signal input.

When the operation jig 7 is set, as indicated by the alternate long and short dashed line in FIG. 5, the light-receiving condition of the central light-receiving element 6a is different from those of the end light-receiving elements 6b and 6c. In this case, signal input is the same as the manner described in FIG. 2. However, when the user sets the jig 7 on the light-receiving elements, a bright or dark condition can be assigned to the light-receiving elements in accordance with the shapes of the identification marks, since the identification mark 6a' is circular and the identification marks 6b' and 6c' are square.

With this alternative electronic timepiece, even if time correction or the like is rarely performed, the user can easily perform such correction in accordance with the identification marks, without errors.

Figure 6:
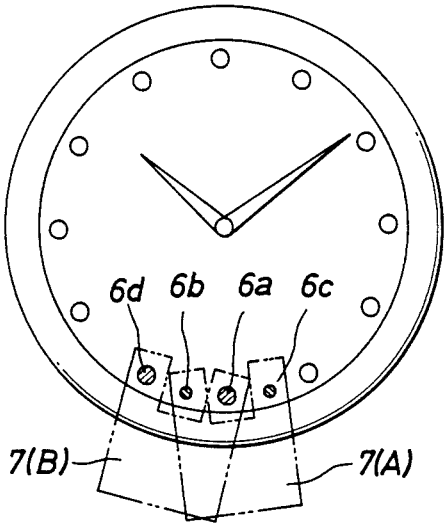

FIG. 6 is a front view of still another electronic timepiece according to the present invention. This electronic timepiece is substantially the same as that of FIG. 2 except that a light-receiving element 6d is arranged to constitute a pair with the light-receiving element 6a. The user can selectively set the operation jig 7 on the light-receiving elements 6a, 6b, 6c, and 6d in a state A or B indicated in the drawing, thereby switching the pair of elements 6a and 6d, and the pair of elements 6b and 6c.

In this embodiment, the state A of the operation jig 7 indicates the forward (clockwise) correction of the analog timer display, and the state B indicates the reverse (counterclockwise) correction thereof.

Figure 7:
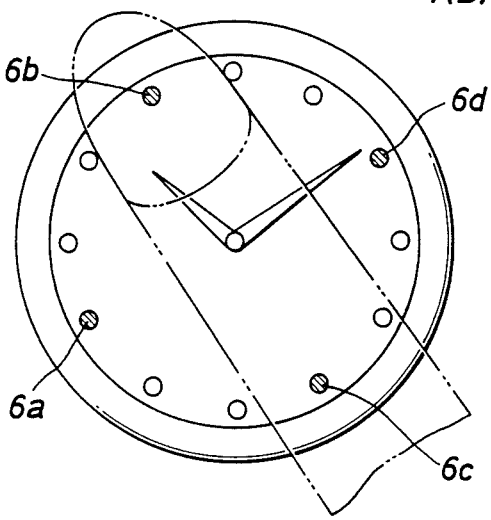

FIG. 7 is a front view of still another electronic timepiece according to the present invention. The electronic timepiece of FIG. 7 is different from that of FIG. 6 in that pairs of light-receiving elements 6a and 6d, 6b and 6c, . . . are arranged in diagonal positions with respect to the center of the face 5, and the pair of elements 6a and 6d is perpendicular to that of elements 6b and 6c. The element 6a represents 8 o'clock; 6b, 11 o'clock; 6c, 5 o'clock; and 6d, 2 o'clock. The user places his finger to cover the pair of elements 6a and 6d at diagonal positions to achieve time correction. In this case, the operation jig 7 is not required.

Figure 8:
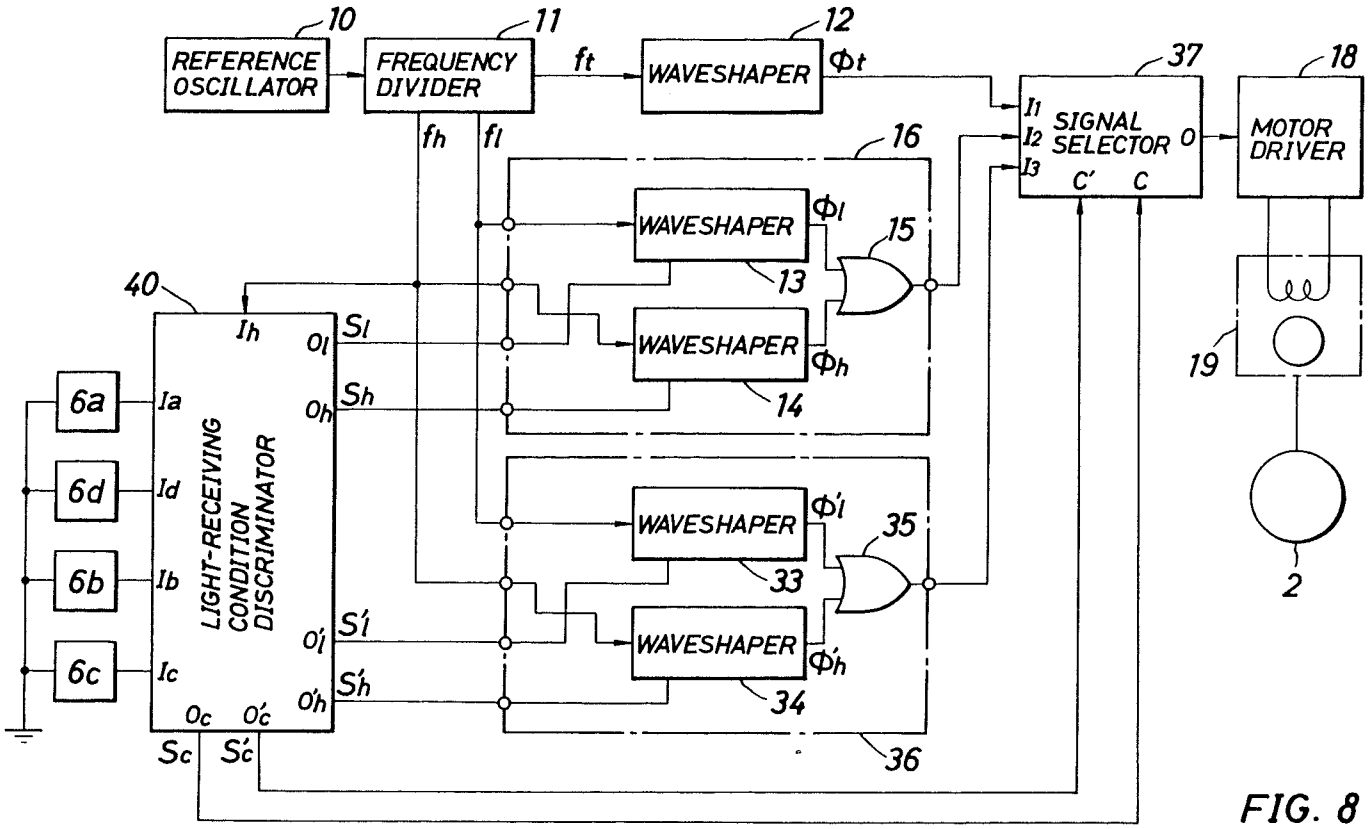
FIG. 8 is a system block diagram of an electronic timepiece according to another embodiment of the present invention.

FIG. 8 is a system block diagram of an electronic timepiece with four light-receiving elements shown in FIGS. 6 and 7 according to a second embodiment of the present invention. This embodiment is different from the embodiment of FIG. 1 in that a light-receiving condition discriminator 40 discriminates light-receiving conditions of the four light-receiving elements 6a, 6b, 6c, and 6d. The light-receiving condition discriminator 40 generates a low-speed reverse correction control signal Sl', a high-speed reverse correction control signal Sh' and a selection control signal Sc' in addition to the low- and high-speed correction control signals and the selection control signal Sc from the light-receiving condition discriminator 20 shown in FIG. 1. Furthermore, a reverse correction signal generator 36 is arranged to receive the low- and high-speed reverse correction control signals Sl' and Sh' and generates low- and high-speed reverse correction signals $\phi l'$ and $\phi h'$. A signal selector 37 has an input terminal I3 for receiving the reverse correction signal from the reverse correction signal generator 36, in addition to input terminals I1 and I2 for receiving a time count signal $\phi t$ and a correction signal from a correction signal generator 16. The selector 37 selects one of these three input signals in resposne to the two selection control signals Sc and Sc', and a selected signal appears at an output terminal O thereof.

The reverse correction signal generator 36 consists of waveshapers 33 and 34 and an OR gate 35 to generate a reverse correction signal. The generator 36 generates the low- and high-speed reverse correction signals $\phi l'$ and $\phi h'$ in the same manner as the correction signal generator 16.

Figure 9:
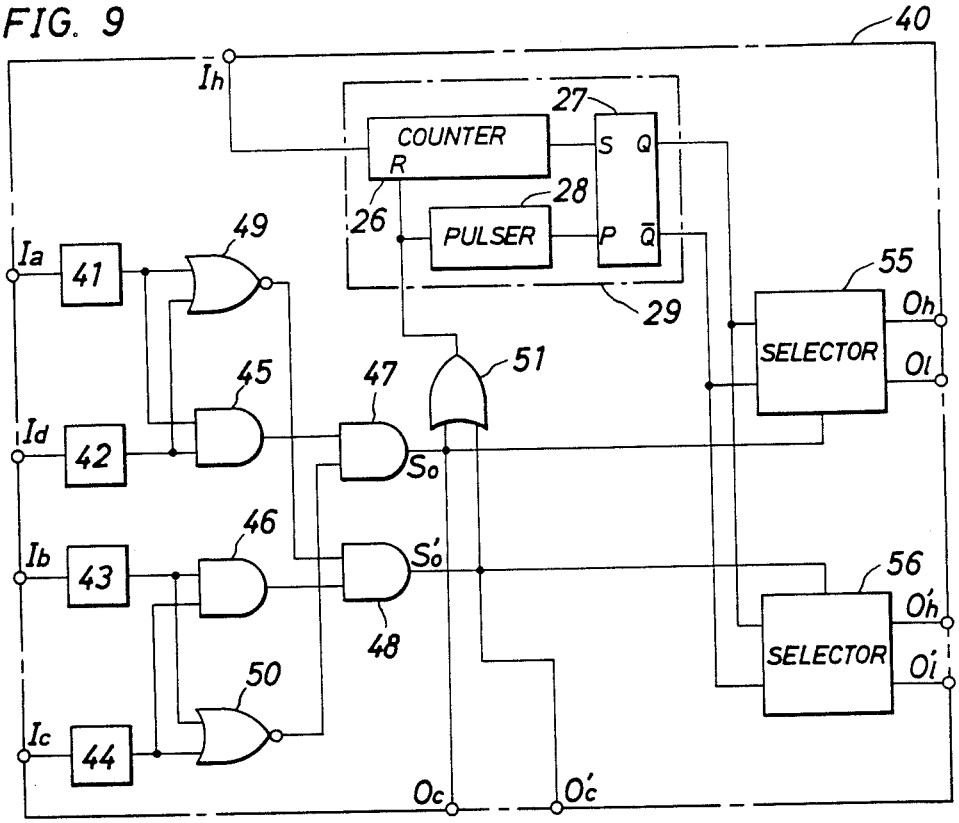
FIG. 9 is a block diagram of a light-receiving condition discriminator in the electronic timepiece of FIG. 8.

FIG. 9 is a block diagram showing the detailed arrangement of the light-receiving condition discriminator 40. Light-receiving signal generators 41, 42, 43, and 44 receive the signals from the four light-receiving elements 6*a*, 6*d* , 6*c*, and 6*c* and generate an ON/OFF signal on the basis of a predetermined level thereof. Reference numerals 45, 46, 47, and 48 denote AND gates; 49 and 50, NOR gates; and 51, an OR gate. The AND gates 45 and 46 generate signals of logic "1" only when the signals from the light-receiving signal generators 41 and 42, or 43 and 44 are both logic "1". The NOR gates 49 and 50 generate signals of logic "1" only when the signals from the light-receiving signal generators 41 and 42, or 43 and 44 are both logic "0".

The AND gate 47 generates a condition signal S0 of logic "1" only when light is incident on the light-receiving elements 6*a* and 6*d* and is not incident on the light-receiving elements 6*b* and 6*c*. However, the AND gate 48 generates a reverse condition signal S0' of logic "1" only when light is incident on the elements 6*b* and 6*c* and is not on the elements 6*a* and 6*d*.

Reference numeral 29 denotes the same timer circuit as the timer circuit 29 of FIG. 4; and 55 and 56, selectors. The selectors 55 and 56 receive the Q and $\overline{Q}$ outputs of an RS-FF 27 constituting the timer circuit 29 and selectively generate the correction control signals Sl and Sh or the reverse correction control signals Sl' and Sh' in response to the condition signals S0 and S0' from the AND gates 47 and 48, respectively.

When the operation jig 7 is set in the state A of FIG. 6 or in the state shown in FIG. 7, the selector 55 is enabled to generate the condition signal S0. The correction control signals Sl and Sh appear at the output terminals Ol and Oh. However, when the operation jig 7 is set in the state B of FIG. 7 and the state opposite that in FIG. 7 is set (i.e., the finger covers the light-receiving elements 6*a* and 6*d*), the selector 56 is enabled by the reverse condition signal S0'. In this case, the reverse correction control signals Sl' and Sh' appear at the output terminals Ol' and Oh' of the selector 56. Otherwise, the condition signal S0 and the reverse condition signal S0' are not generated, and hence neither correction control signal is generated.

The correction operation of the electronic timepiece shown in FIGS. 6 and 7 will be described with reference to FIG. 8.

As described above, when the operation jig 7 or the finger does not cover appropriate light-receiving elements, the selection control signals Sc and Sc' do not appear at the output terminals Oc and Oc' of the light-receiving condition discriminator 40. In this case, the selector 37 selects the time count signal $\phi t$ from the input terminal I1 to the output terminal O thereof. Normal time counting in a 20-second cycle is performed.

Time correction is performed in the following manner.

When the user wishes to correct the timepiece in the forward direction, the operation jig 7 is set in the state A of FIG. 6 or the finger is set in a position indicated by the alternate long and two dashed line in FIG. 7. The signal selector 37 selects the input terminal I2 upon generation of the selection control signal Sc at the output terminal Oc of the light-receiving condition discriminator 40. The low-speed correction control signal Sl appears at the output terminal Ol. After a predetermined period of time, the high-speed correction control signal Sh appears at the output terminal Oh in place of the low-speed signal Sl. As a result, the correction signal generator 16 generates the low- and high-speed correction signals $\phi l$ and $\phi h$, and the analog timer display 2 is corrected in the forward direction through the signal selector 37.

In order to correct the timepiece in the reverse direction, the operation jig 7 is set in the state B of FIG. 6 of the light-receiving elements 6*a* and 6*d* are covered with a finger, opposite to that shown in FIG. 7. The signal selector 37 selects an input terminal I3 upon generation of the selection control signal Sc' at the output terminal Oc' of the light-receiving condition discriminator 40. The low-speed reverse correction control signal Sl' appears at the output terminal Ol'. After a predetermined period time, the high-speed reverse correction control signal Sh' appears at the output terminal Oh'. As a result, the reverse correction signal generator 36 generates the low- and high-speed reverse correction signals $\phi l'$ and $\phi h'$. The pulse motor 19 is driven in the reverse direction through the signal selector 37, thereby correcting the analog timer display 2 in the reverse direction.

Thus, the user can use both forward and reverse correction operations to quickly correct time.

The operation jig 7 is made of an opaque material such as a metal plate, plastic or paper and is featured as an accessory at the time of purchase. Even if the operation jig is lost, the user can easily make an operation jig by himself. When an operation jig 7 cannot be immediately prepared, two adjacent fingers with a gap between them can be used to cause switching.

Figure 10:
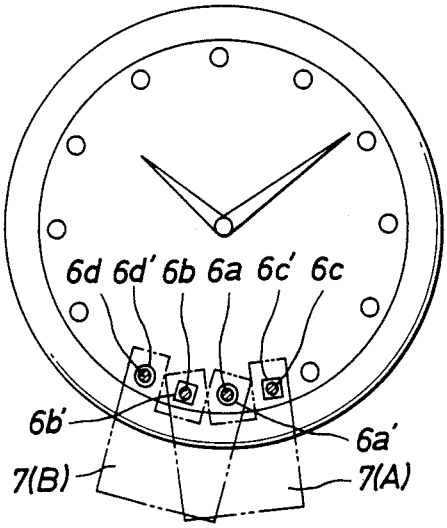
FIGS. 10 and 11 are front views of other electronic timepieces according to the present invention.

FIG. 10 is a front view of still another electronic timepiece of the present invention. This timepiece is different from that of FIG. 6 in that circular identification marks 6*a'* and 6*d'* and square identification marks 6*b'* and 6*c'* are provided to four light-receiving elements 6*a*, 6*d*, 6*b*, and 6*c*, respectively.

Figure 11:
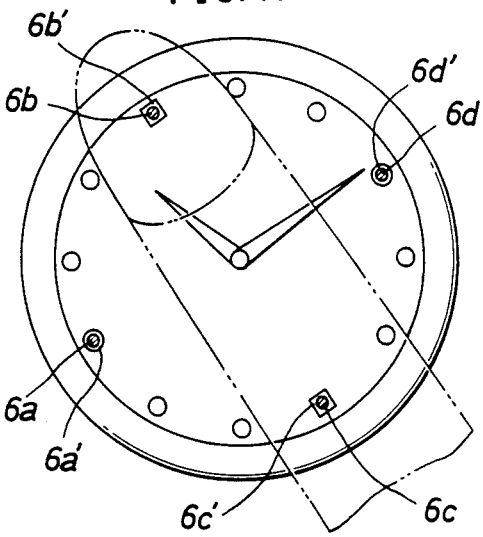

FIG. 11 is a front view of still another electronic timepiece of the present invention. This timepiece is different from that of FIG. 7 in that circular identification marks 6*a'* and 6*d'* and square identification marks 6*b'* and 6*c'* are provided to four light-receiving elements 6*a*, 6*d*, 6*b*, and 6*c*, respectively.

When the user wishes to correct time, e.g., when the timepiece is corrected in the forward direction, the operation jig 7 is placed to cover the elements 6*b* and 6*c* in the state A of FIG. 10 in accordance with the shapes of the identification marks 6*a'*, 6*b'*, 6*c'*, and 6*d'*. When the timepiece is corrected in the reverse direction, a finger is placed to cover the elements 6*a* and 6*d* in the state B of FIG. 10. Therefore, the forward and reverse correction operations are performed as shown in FIGS. 8 and 9. In this case, since different-shaped marks are used, forward or reverse correction can be easily performed.

In this embodiment, the circuit controlled by the light-receiving elements is exemplified by a time correction circuit. However, the circuit to be controlled is not limited to this. The present invention can also be applied to control for an additional function circuit and an increment adjustment circuit.

Figure 12:
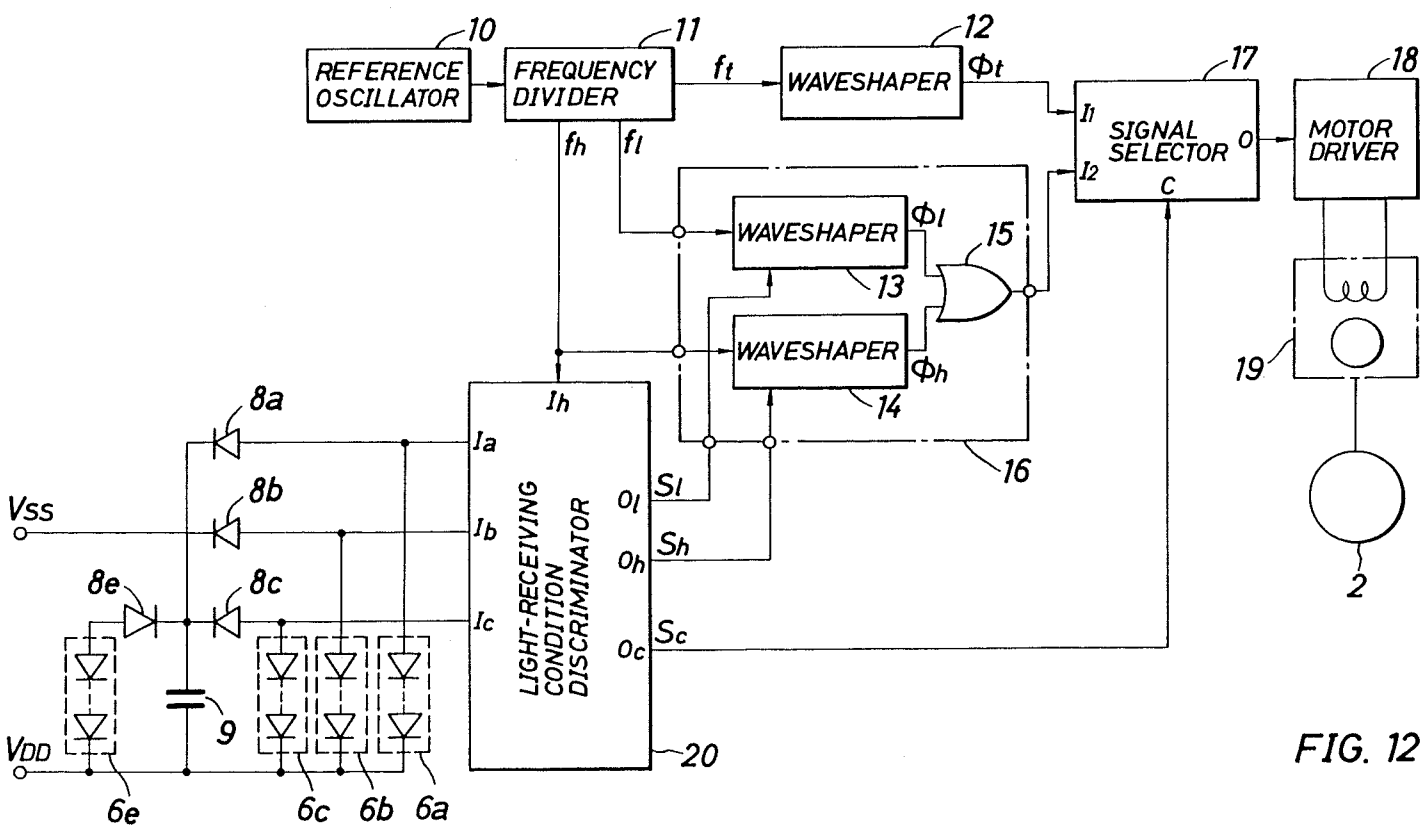
FIG. 12 is a system block diagram of an electronic timepiece according to still another embodiment of the present invention.

FIG. 12 is a system block diagram of an electronic timepiece according to a third embodiment of the present invention. This embodiment exemplifies a signal input device for time correction in the same manner as in the embodiment of FIG. 1.

The same reference numerals in FIG. 12 denote the same parts as in FIG. 1. The third embodiment is different from the embodiment of FIG. 1 in that three solar cell blocks 6a, 6db, and 6c are used as light-receiving elements and that the solar cell blocks 6a, 6b, and 6c are connected together with another solar cell block 6e in parallel with a capacitor 9 through rectifying diodes 8a, 8b, 8c, and 8d. Voltages generated by the solar cell blocks 6a, 6b, 6c, and 6e are supplied to and then charge the capacitor 9. A voltage from the capacitor 9 is then supplied from power source terminals VDD to VSS to a timer circuit. The solar cell blocks 6a, 6b, and 6c serve as light-receiving elements and are directly connected to input terminals Ia, Ib, and Ic of a light-receiving condition discriminator 20. The detailed arrangement of the light-receiving discriminator 20 is the same as that illustrated in FIG. 4.

Figure 13:
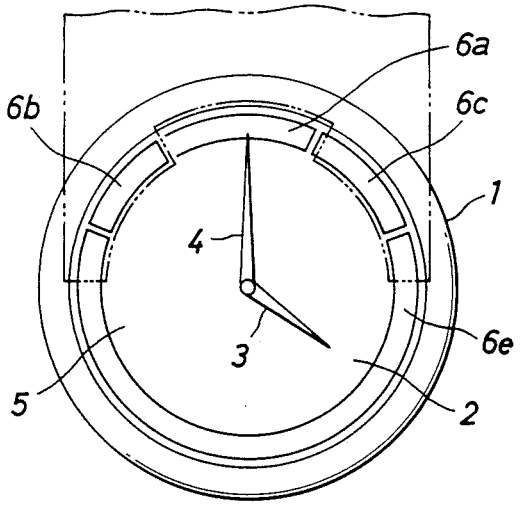
FIG. 13 is a front view of still another electronic timepiece according to the present invention.

FIG. 13 is a front view of the electronic timepiece shown in FIG. 12. The electronic timepiece includes a case 1 and an analog timer display 2. The analog timer display 2 consists of an "hour" hand 3, a "minute" hand 4 and a face 5. The four solar cell blocks 6a, 6b, 6c, and 6e are arranged at predetermined angular positions on the face 5. The three solar cell blocks 6a, 6b, and 6c serve as the input light-receiving elements.

Figure 14:
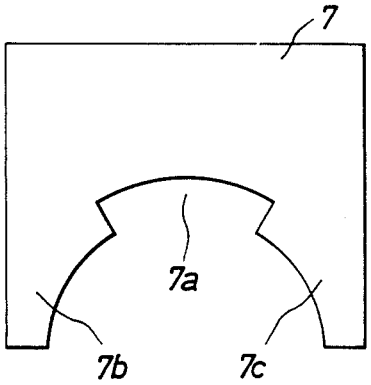
FIG. 14 is a plan view of an operation jig used for inputting a signal to the electronic timepiece of FIG. 13.

FIG. 14 shows an operation jig 7 used for externally controlling the above electronic timepiece.

In order to correct time, the operation jig 7 is place at a position as indicated by the alternate long and short dashed line in FIG. 13. The blocks 6b and 6c are thus covered with the jig 7, and only the block 6a is exposed to light. In the same manner as in the embodiment of FIGS. 1 and 2, the light-receiving condition discriminator 20 generates a selection control signal Sc and a low-speed correction control signal Sl 10 seconds after the jig is set. After 10 seconds, a high-speed correction signal Sh is generated, thereby performing a series of time correction operations. Time correction is performed in the same manner as in the device of FIG. 1, and a detailed description thereof will be omitted.

In the embodiment of FIG. 12, the diodes 8a, 8b, 8c, and 8e prevent the charges of the capacitor 9 from flowing toward the solar cell blocks 6a, 6b, 6c, and 6e when voltages therein are lower than a voltage across the capacitor 9.

In this embodiment, the circuit controlled by the solar cell blocks is exemplified by the time correction circuit in the analog timer display of the first and second embodiments, but is not limited thereto. The present invention can also be applied to control for an additional function circuit and an increment adjustment circuit.

Figure 15:
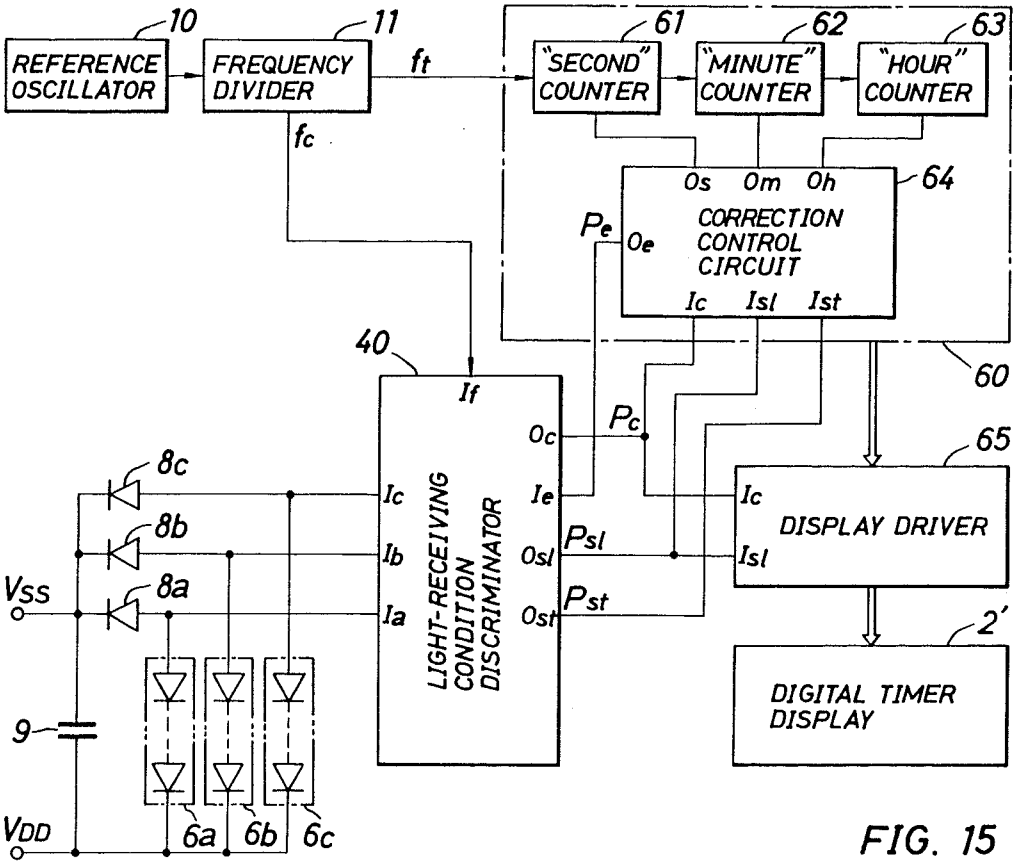
FIG. 15 is a system block diagram of an electronic timepiece according to still another embodiment of the present invention.
Figure 16:
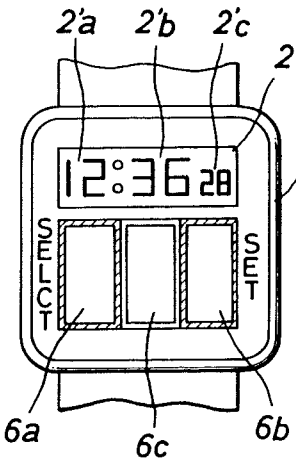
FIG. 16 is a front view of still another electronic timepiece according to the present invention.

FIG. 15 is a system block diagram of an electronic timepiece according to still another embodiment of the present invention, and FIG. 16 shows an outer appearance of the electronic timepiece.

The electronic timepiece shown in FIG. 16 is a digital timepiece with a digital timer display 2'. The digital time display consists of an "hour" display section 2a', a "minute" display section 2b' and a "second" display section 2c'. Three light-receiving elements 6a, 6b, and 6c are arranged below the digital timer display 2'. Word "SELECT" is printed near the light-receiving element 6a and indicates a selection switch. Word "SET" is printed near the light-receiving element 6b and indicates a correction switch. In this embodiment, the light-receiving elements 6a, 6b, and 6c are made of solar cell blocks, respectively. The blocks have both control switch and energy source functions. In order to distinguish the light-receiving elements 6a and 6b as control switches, they are outlined with a color different from that of the outline of the element 6c.

Figure 17:
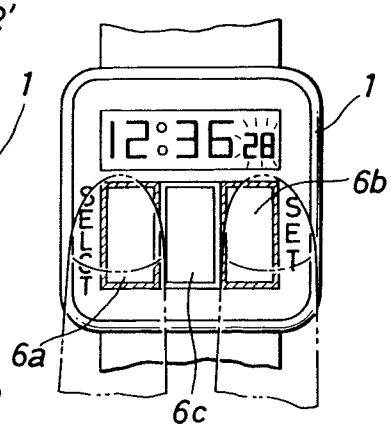
FIG. 17 is a front view showing a state wherein the electronic timepiece in FIG. 16 is held in a correction control state.

FIG. 17 shows a correction control state. As indicated by the alternate long and short dashed line, light to be incident on the light-receiving elements is controlled by a finger to achieve a signal input to be described later.

In the system block diagram of FIG. 15, reference numeral 10 denotes a reference oscillator; and 11, a frequency divider. The frequency divider 11 generates a time count signal ft of a 1-second period and a high-speed clock signal fc.

Reference numeral 60 denotes a known time count circuit. The time count circuit 60 consists of a "second" counter 61, a "minute" counter 62, an "hour" counter 63, and a correction control circuit 64 for correcting the counters 61 to 63. The time count circuit 60 receives the time count signal ft and generates "hour", "minute", and "second" data to be supplied to a display driver 65. The digital timer display 2' receives the signal from the display driver 65 and performs digital time display.

Reference numeral 40 denotes a light-receiving condition discriminator. The discriminator 40 receives signals from the three light-receiving elements 6a, 6b, and 6c at input terminals Ia, Ib, and Ic thereof and generates a control enable signal Pc, a correction digit selection signal Psl, and a correction signal Pst at its output terminals Oc, Osl, and Ost. A correction end signal Pe from the correction control circuit 64 and a clock signal fc from the frequency divider 11 are supplied to input terminals Ie and If of the discriminator 40. Reference numerals 8a, 8b, and 8c denote rectifying diodes; and 9, a capacitor. The light-receiving elements 6a, 6b, and 6c are directly connected to the input terminals Ia, Ib, and Ic of the light-receiving condition discriminator 40. At the same time, the elements 6a, 6b, and 6c are connected in parallel with the capacitor 9 through the diodes 8a, 8b, and 8c. The voltages from the light-receiving elements 6a, 6b, and 6c are charged by the capacitor 9. A voltage across the capacitor 9 is supplied from the power source terminals VDD and VSS to the time count circuit 60.

Figure 18:
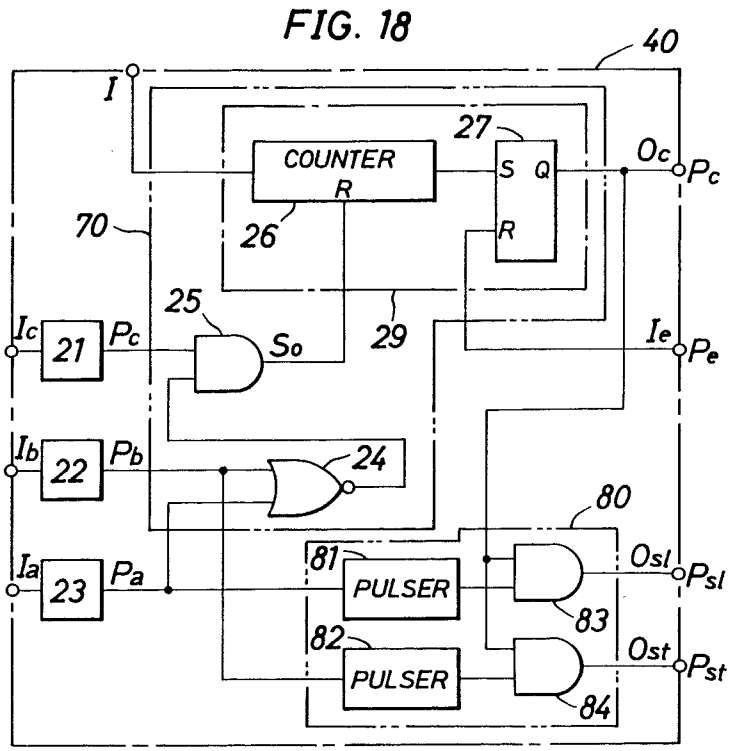
FIG. 18 is a block diagram of a light-receiving condition discriminator in the electronic timepiece shown in FIG. 15.

FIG. 18 is a block diagram showing the detailed arrangement of the light-receiving condition discriminator 40 shown in FIG. 15. The arrangement of this circuit is similar to that of the light-receiving condition discriminator 20 of FIG. 4. The same reference numerals in FIG. 18 denote the same parts as in FIG. 4.

Referring to FIG. 18, reference numerals 21, 22, and 23 denote light-receiving signal generators. The generators 21, 22 and 23 receive the light-receiving signals from the light-receiving elements 6a, 6b, and 6c and generate ON/OFF signals Pa, Pb, and Pc in accordance with a predetermined level thereof.

A NOR gate 24 generates a signal of logic "1" when both the output signals from the light-receiving signal generators 22 and 23 are held low. An AND gate 25 normally generates a signal of logic "0". However, the AND gate 25 generates a condition signal S0 of logic "1" only if both the output signals from the light-receiving signal generator 21 and the NOR gate 24 are set at logic "1". A counter 26 receives the clock signal fc from an input terminal If. An RS flip-flop (to be referred to as an RS·FF) 27 is set in response to the output signal from the counter 26. The counter 26 and the RS·FF 27 constitute a timer circuit 29. The NOR gate 24, the AND gate 25 and the timer circuit 29 constitute an enable signal generator 70 for generating the control enable signal Pc.

Reference numerals 81 and 82 denote pulsers; and 83 and 84, AND gates. The pulsers 81 and 82 and the AND gates 83 and 84 constitute a control signal generator 80 for generating the correction digital selection signal Psl and the correction signal Pst.

The operation of the light-receiving condition discriminator 40 shown in FIG. 18 will be described hereinafter. In the initial state, the RS·FF 27 is reset, and an output Q thereof is held at logic "0". The control enable signal Pc does not appear at the output terminal Oc. The AND gates 83 and 84 adapted to receive the Q output from the RS·FF 27 are disabled. The correction digit selection signal Psl and the correction signal Pst do not appear at the output terminals Osl and Ost, either. As shown in FIG. 16, assuming the light-receiving conditions of the elements *6a*, *6b*, and *6c*, light is incident on the central element *6c* and not on the end elements *6a* and *6b*. Such conditions are not established in a normal operation state. In normal operation, light is incident on all of the light-receiving elements or on none. Even if the light-receiving elements are partially covered with the sleeve of a shirt, the central element *6c* and the element *6a* or *6b* are covered with the sleeve. The light-receiving condition for allowing light to be incident only on the element *6c* is established such that two fingers are intentionally placed on the light-receiving elements *6a* and *6b*, as shown in FIG. 17, or an operation jig is used. Referring to FIG. 18, when fingers are not placed to intentionally cover some light-receiving elements, all the output signals Pc, Pb and Pa from the light-receiving signal generators 21, 22, and 23 are set at logic "1". The output signal from the NOR gate 24 is held at logic "0". The AND gate 25 does not generate the condition signal S0 and is therefore held at logic "0".

The counter 26 is reset, and thus the timer circuit 29 is stopped (when a reset terminal R of the counter 26 is set at logic "0", the counter 26 is reset, and the resetting of the counter 26 is cancelled in response to the condition signal of logic "1").

When light is not incident on the light-receiving element *6c* due to the presence of a sleeve or the like, the signal Pc from the generator 21 is held at logic "0". As a result, the condition signal S0 is not generated, regardless of the light-receiving conditions of the other elements *6a* and *6b*.

In the normal operation of the timepiece, the RS·FF 27 is reset, its output Q goes to logic "0", and the AND gates 83 and 84 in the control signal generator 80 are disabled.

In this state, when the user sets his fingers at positions indicated by the alternate long and short dashed line in FIG. 17, light is incident on only the light-receiving element *6c*. The output signal Pc from the light-receiving signal generator 21 is enabled, and the output signals Pb and Pa from the generators 22 and 23 are disabled.

The output from the NOR gate 24 is set at logic "1", and the condition signal S0 of logic "1" is generated by the AND gate 25. The signal S0 is supplied to the timer circuit 29 to cancel the resetting of the counter 26. The counter 26 starts counting the clock signal fc supplied from the input terminal If. When a predetermined time (10 seconds in this embodiment) has elapsed, the timer 26 generates an output signal to set the RS·FF 27, thus inverting an output terminal Q of the RS·FF 27 to logic "1". The control enable signal Pc appears at the output terminal Oc, and at the same time, the AND gates 83 and 84 are enabled. Therefore, the control signal generator 80 is held operative. In this state, when a finger repeatedly covers or is removed from the SELECT light-receiving element *6a*, the bright/dark signal Pa is pulsated by the pulser 81 and appears as the correction digit selection signal Psl at the output terminal Osl through the AND gate 83. When the finger repeatedly covers and is removed from the SET element *6b*, the bright/dark signal Pb is pulsated by the pulser 82 and appears as the correction signal Pst at the output terminal Ost through the AND gate 84.

As shown in FIG. 17, the light-receiving condition discriminator 40 can be held in the correction enable state when the light-receiving elements *6a* and *6b* are set in the dark state and the light-receiving element *6c* is set in the bright mode for 10 seconds. In this state, the light is intermittently incident on the element *6a* to generate the correction digit selection signal Psl. The light is intermittently incident on the element *6b* to generate the correction signal Pst. This correction enable state continues until the correction end signal Pe is supplied to an input terminal Ie and the RS·FF 27 is reset.

The time correction of the electronic timepiece on the basis of the light-receiving condition discriminator 40 will be described with reference to FIG. 15. As previously described, in the normal state wherein the light-receiving elements *6a*, *6b*, and *6c* are not controlled by a finger or the like, the correction enable signal Pc does not appear at the output terminal Oc of the control signal generator 80, and the correction control circuit 64 and the display driver 65 are held in the noncorrection mode. The time data generated by the time count circuit 60 is supplied to the digital timer display 2' through the display driver 65 and is digitally displayed on the display 2'.

Time correction is started in this state. The user controls the light-receiving elements with his fingers such that the light is not incident on the elements *6a* and *6b*, but is incident on the element *6a* for 10 seconds. The correction enable signal Pc appears at the output terminal Oc and is supplied to the correction designation terminals Ic of the correction control circuit 64 and the display driver 65. In this state, the "second" correction terminal Os of the correction control circuit 64 is designated, and the display driver 65 causes the "second" display section 2c in the digital timer display 2' to flicker, thereby signalling to the user that the "second" correction mode is set.

The "second" digit is corrected, the light-receiving element *6b* is covered once, and then the correction signal Pst from the output terminal Ost of the discriminator 40 resets the "second" counter 61 through the input terminal Ist of the correction control circuit 64 and the "second" correction terminal Os, thereby setting the "second" digit to zero.

When the user covers the light-receiving element *6a* once with his finger, the correction digit selection signal Psl from the output terminal Osl of the discriminator 40 is supplied to the input terminal Isl of the correction control circuit 64, so that the "minute" correction terminal Om is designated. At the same time, the selection signal Psl is supplied to the input terminal Isl of the display driver 65 to flicker the "minute" display section 2b of the digital timer display 2'. In this state, when the user covers the light-receiving element *6b* with his finger, the correction signal Pst from the discriminator 40 is supplied from the output terminal Ist of the correction control circuit 64 to the "minute" counter 62 through the "minute" correction terminal Om. The count of the "minute" counter is incremented by the number of pulses of the correction signal Pst. Similarly, "minute" correction is completed, and the user covers again the element 6a with his finger to set the "hour" correction mode. The user then covers the element 6b with the finger to correct the "hour" digit. When "hour", "minute", and "second" correction operations are completed, the user then covers the element 6b to generate the correction digit selection signal Psl. The signal Psl is supplied to the correction control circuit 64. The designation state is switched from the "hour" correction terminal Oh of the correction control circuit 64 to the correction end terminal Oe. The correction end signal Pe is supplied to the input terminal Ie of the discriminator 40. As shown in FIG. 18, the correction end signal Pe supplied to the input terminal Ie of the light-receiving condition discriminator 40 resets the RS·FF 27. An output Q from the RS·FF 27 is reset to logic "0" to disable the correction enable signal Pc at the output terminal Oc. Therefore, the correction control circuit 64 and the display driver 65 are restored in the normal operation, and correction is thus completed.

Figure 19:
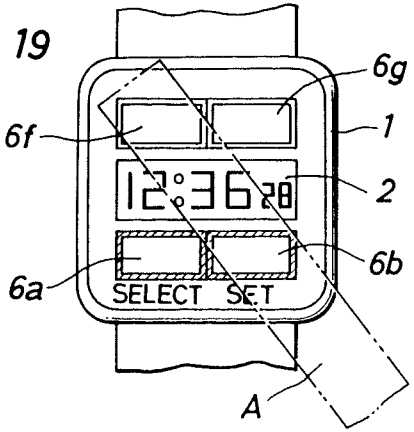
FIG. 19 is a front view of still another electronic timepiece according to the present invention.

FIG. 19 is a plan view showing still another electronic timepiece according to the present invention. Two upper solar cell blocks and two lower solar cell blocks are arranged to sandwich a digital timer display therebetween. The lower solar cell blocks consist of a digit selection light-receiving element 6a and a correction light-receiving element 6b. The upper solar cell blocks consist of condition setting light-receiving elements 6f and 6g.

In the electronic timepiece with the arrangement described above, time correction is performed in the following manner. A correction jig A is placed to cover the light-receiving elements 6b and 6f for 10 seconds to access the correction enable mode. In this mode, the correction digit selection element 6a and the correction element 6b are intermittently shielded to correct time as described above.

The correction jig A need not be a special one but can be substituted by another object such as a pencil.

Figure 20:
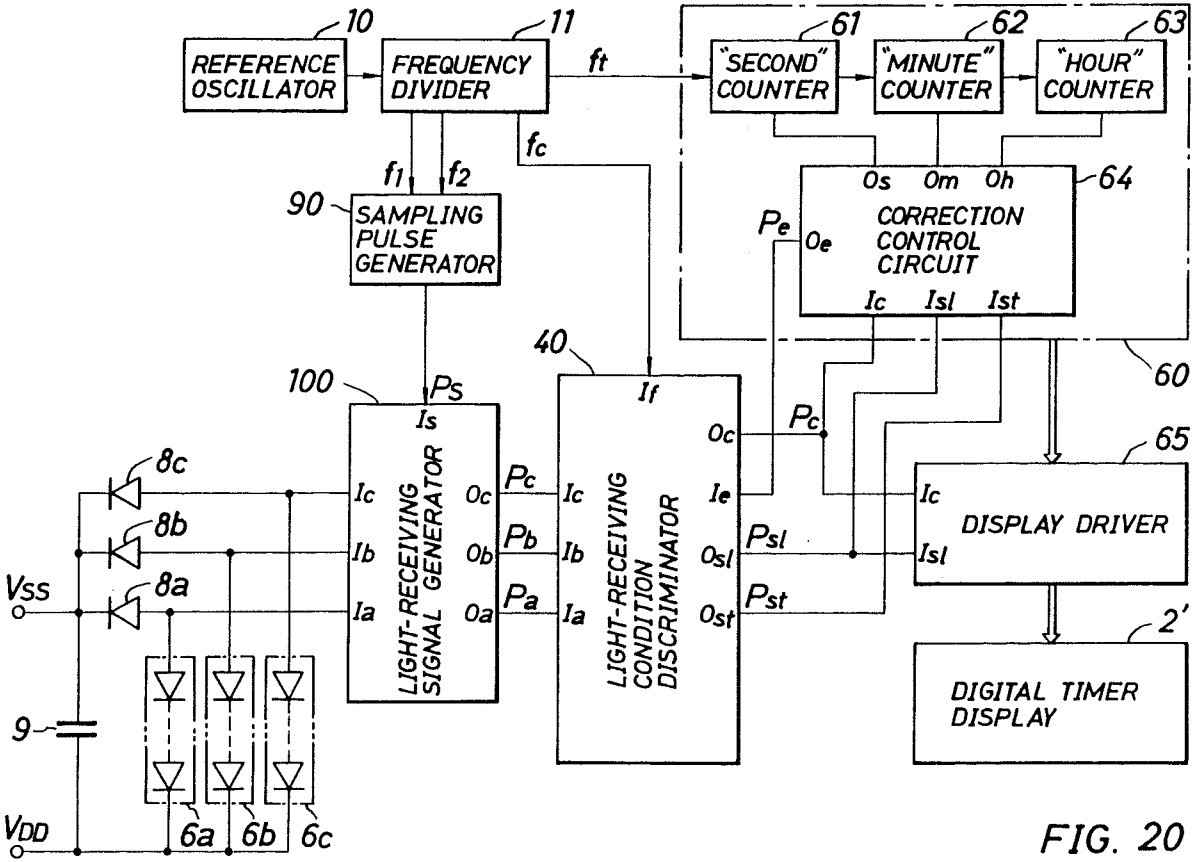
FIG. 20 is a system block diagram of an electronic timepiece according to still another embodiment of the present invention.

FIG. 20 is a system block diagram of an electronic timepiece according to still another embodiment of the present invention.

This embodiment resembles that of FIG. 15, and the same reference numerals in FIG. 20 denote the same parts as in FIG. 15. However, the power consumption of the electronic timepiece of FIG. 20 can be reduced as compared with that of FIG. 15.

The main feature of the embodiment of FIG. 20 lies in the fact that a light amount detector time-divisionally detects light amounts of the respective light-receiving elements to decrease the power consumption.

The same reference numerals as in FIG. 20 denote the same as in FIG. 15, and a detailed description thereof will be omitted.

Referring to FIG. 20, reference numeral 90 denotes a sampling pulse generator. The generator 90 receives frequency-divided signals f1 and f2 from the respective frequency division stages of a frequency divider 11, as shown in FIGS. 23A, 23B and 23C. The sampling pulse generator 90 generates a sampling pulse Ps of a period f1 and a pulse width f2.

A light-receiving signal generator 100 receives voltages Eh from light-receiving elements 6a, 6b, and 6c at its input terminals Ia, Ib, and Ic and generates light-receiving signals Pa, Pb, and Pc from its output terminals Oa, Ob, and Oc.

A light-receiving condition discriminator 40 receives the signals Pa, Pb, and Pc from the generator 100 and generates a control enable signal Pc, a correction digit selection signal Psl and a correction signal Pst from its output terminals Oc, Osl and Ost. A correction end signal Pe from a correction control circuit 64 and a clock signal fc from the frequency divider 11 are supplied to input terminals Ie and If, respectively. Reference numerals 8a, 8b, and 8c denote rectifying diodes; and 9, a capacitor. The light-receiving elements 6a, 6b, and 6c are directly connected to the input terminals Ia, Ib, and Ic of the light-receiving signal generator 100, respectively. At the same time, the elements 6a, 6b, and 6c are connected in parallel with the capacitor 9 through the diodes 8a, 8b, and 8c. The voltages from the elements 6a, 6b, and 6c as the solar cell blocks charge the capacitor 9. A voltage across the capacitor 9 is supplied from power source terminals VDD and VSS to a timer circuit.

Figure 21:
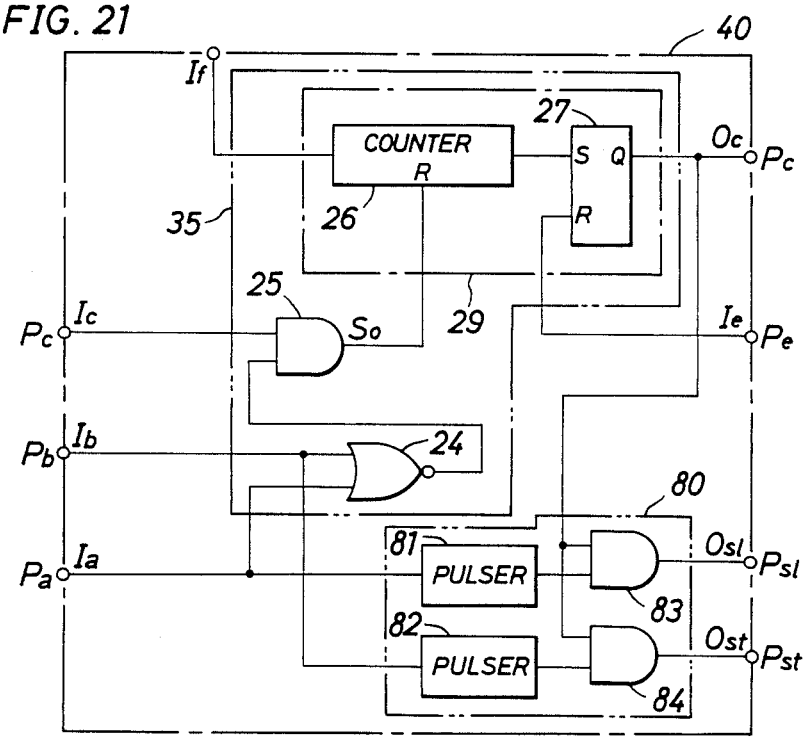
FIG. 21 is a block diagram of a light-receiving condition discriminator in the electronic timepiece in FIG. 20.

FIG. 21 is a block diagram showing the detailed arrangement of the light-receiving condition discriminator 40. This discriminator resembles the discriminator 40 of FIG. 18, and only a difference between them is that the discriminator in FIG. 21 does not include the light-receiving signal generators 21, 22, and 23. Therefore, a detailed description of its circuit arrangement will be omitted.

Figure 22:
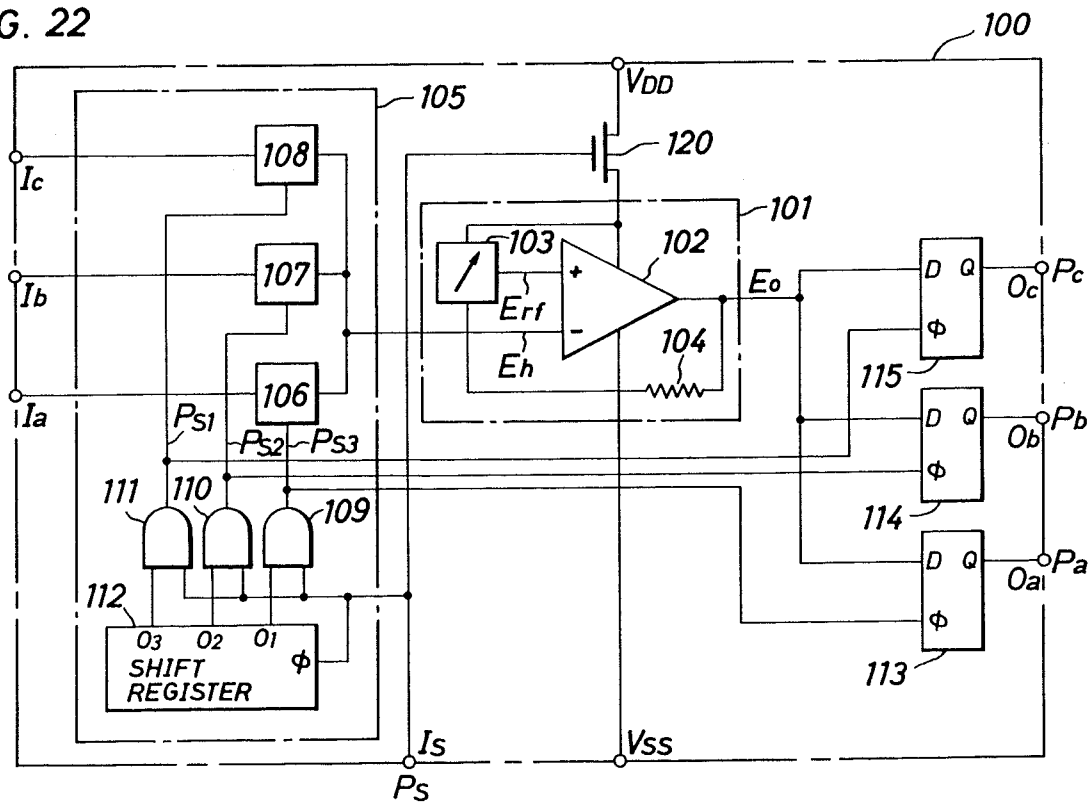
FIG. 22 is a block diagram of another light-receiving condition discriminator in the electronic timepiece in FIG. 20.

FIG. 22 is a block diagram showing the detailed arrangement of the light-receiving signal generator 100.

Reference numeral 101 denotes a light amount detector. The detector 101 includes a comparator 102, a reference voltage generator 103, and a pull-down resistor 104 for decreasing a voltage voltage from the comparator 102. The light amount detector 101 compares a reference voltage Erf supplied to the noninverting terminal of the comparator with voltages Eh from the light-receiving elements 6a, 6b, and 6c supplied to the inverting input terminal of the comparator 102, and generates an output voltage E0 of logic "1" only if Eh>Erf. The reference voltage generator 103 comprises a variable voltage generator for generating the variable reference voltage Erf for setting a level of the voltages Eh. A selector 105 includes three transmission gates (to be referred to as TGs hereinafter) 106, 107, and 108, AND gates 109, 110, and 111 for supplying the sampling pulse Ps to the TGs 106, 107, and 108, and a shift register 112 for time-divisionally enabling/disabling the AND gates 109, 110 and 111.

The operation of the selector 105 will be described with reference to the timing charts of FIGS. 22A to 22G. Assume that the shift register 112 designates an output terminal O1, as shown in FIG. 23D. Since the AND gate 109 is turned on, the sampling pulse Ps is gated therethrough and appears as the signal Ps1. The TG 106 is kept on for a duration corresponding to the pulse width of the sampling pulse Ps. The voltage Eh supplied to the input terminal Ia for this duration is supplied to the inverting liquid terminal of the comparator 102. The sampling pulse Ps1 is supplied to the clock terminal $\phi$ of the shift register 112. The shift register 112 performs shifting at the trailing edge of the sampling pulse Ps1. As shown in FIG. 23E, the terminal designation is switched to that of an output terminal O2, and then the AND gate 110 is turned on. The next sampling pulse Ps is gated through the AND gate 110 and appears as the signal Ps2. The TG 107 is turned on in response to the signal Ps2, and thus the voltage Eh supplied to the input terminal Ib is supplied to the inverting input terminal of the comparator 102. An output terminal O3 of the shift register 112 is shifted at the trailing edge of the sampling pulse Ps2, as shown in FIG. 23F.

The shift register 112 repeats shifting whenever the sampling pulse Ps is supplied thereto, and its output terminals O1 to O3 are cyclically designated, as shown in FIGS. 23D, 23E, and 23F. The voltages supplied to the input terminals Ia, Ib, and Ic are time-divisionally supplied to the inverting input terminal of the comparator 102. Reference numerals 113, 114 and 115 denote light-receiving signal storage data flip-flop (to be referred to as D-FFs hereinafter). Data terminals D of the D-FFs 113, 114 and 115 are connected to the output terminal of the comparator 102. The sampling pulse Ps1 gated through the AND gate 109 is supplied to a clock terminal $\phi$ of the D-FF 113. The sampling pulses Ps2 and Ps3 gated through the AND gates 110 and 111 are supplied to the clock terminals $\phi$ of the D-FFs 114 and 115, respectively.

Reference numeral 120 denotes a power source switching transistor. The light amount detector 101 is connected in series between the power source terminals VDD and VSS. The switching transistor 120 is switched in response to the sampling pulse Ps supplied to its gate terminal. As shown in FIG. 23G, the power source voltage EDD is supplied to the light amount detector 101 for a duration corresponding to the pulse width of the sampling pulse Ps.

The signal conversion operation of the light-receiving signal generator 100 with the arrangement described above will be described below.

When the sampling pulse Ps is not input, the switching transistor 120 is kept off. No power source voltage EDD is supplied to the light amount detector 101. In this state, the comparator 102 is disabled. The output terminal of the comparator 102 is pulled down by the resistor 104. The output signal E0 from the comparator 102 is set at logic "0". As shown in FIG. 23D, the output terminal O1 of the shift register 112 is set at logic "1". When the sampling pulse Ps is supplied to the input terminal Ia, the sampling pulse Ps turns on the switching transistor 120 and at the same time renders the light amount detector 101 operative. The sampling pulse Ps is gated through the AND gate 109 and appears as the sampling pulse Ps1 to turn on the TG 106. The voltage Eh supplied to the input terminal Ia is supplied to the inverting input terminal of the comparator 102. The comparator 102 compares the reference voltage Erf with the voltage Eh. If condition Erf>Eh is established, the comparator generates logic "0". However, if condition Erf<Eh, the comparator 102 generates an output voltage Eo of logic "1". This output voltage is supplied to the data terminals D of the D-FFs 113, 114 and 115. At the trailing edge of the sampling pulse Ps1, the logic level of the voltage E0 supplies to the data terminal D of the D-FF 113 is written at the output terminal Q, and the shift register 112 performs shifting. Furthermore, the switching transistor 120 and the TG 106 are turned off, thereby completeing the first light amount detection cycle. When an actual amount of light received by the light-receiving element 6a exceeds a preset amount, the light-receiving signal P5 appears at the output terminal Q of the D-FF 113.

When the sampling pulse Ps2 shown in FIG. 23C is input, the TG 107 is turned on, and the voltage Eh supplied to the input terminal Ib is compared by the comparator 102 with the reference voltage Erf. A comparison result is stored in the D-FF 114, thus completing the second light amount detection cycle.

When the sampling pulse Ps3 shown in FIG. 23C is then input, the TG 108 is turned on, and the voltage Eh supplied to the input terminal Ic is compared by the comparator 102 with the reference voltage Erf. A comparison result is stored in the D-FF 115, and thus the third light amount detection cycle is completed.

The first to third light amount detection cycles are cyclically repeated in response to the sampling pulse Ps. Data updating of the D-FFs 113, 114, and 115 is thus repeated. The light-receiving signals Pa, Pb and Pc appear at the output terminals Oa, Ob and Oc of the light-receiving signal generator 100 in accordance with the levels of the voltages Eh supplied to the input terminals Ia, Ib and Ic in response to the amounts of light received by the light-receiving elements 6a, 6b, and 6c.

In this manner, the amounts of light detected by the plurality of light-receiving elements are detected time-divisionally, and current consumption can be minimized. Furthermore, the external operation member can be eliminated to provide a compact, low-profile, waterproof electronic watch.

What I claim is:

1. An electronic timepiece comprising a housing devoid of control members extending through the housing from an interior to an exterior thereof, a plurality of at least three light-receiving elements arranged to receive external light, a light-receiving condition discriminator for discriminating that a light-receiving condition of a centrally positioned one of the light-receiving elements is different from the light-receiving condition of the other light-receiving elements and thereupon generates the output signal, and a circuit to be controlled in response to the output signal from said light-receiving condition discriminator, the light-receiving elements, the discriminator and the circuit being disposed interiorly of the housing.

2. An electronic timepiece according to claim 1, wherein said light-receiving condition discriminator discriminates that said central one of said at least three light-receiving elements is bright, and said other light-receiving elements are dark.

3. An electronic timepiece according to claim 1, wherein identification marks are provided in association with said plurality of light-receiving elements to identify the light-receiving conditions thereof.

4. An electronic timepiece according to claim 1, wherein said light-receiving discriminator comprises enable signal generating means for discriminating the light-receiving conditions for said three light-receiving elements and generating a control enable signal, and control signal generating means for generating as a control signal at least one of light-receiving signals from said three light-receiving elements.

5. An electronic timepiece according to claim 4, wherein the control enable signal is a signal for causing a time count circuit constituting said electronic timepiece to be able to perform time correction, and said control signal is a signal for causing said time count circuit to perform time correction.

6. An electronic timepiece according to claim 1, wherein said plurality of light-receiving elements comprise a plurality of solar cell blocks, respectively.

7. An electronic timepiece according to claim 6, wherein said plurality of solar cell blocks are connected in parallel with a capacitor serving as an energy source of said electronic timepiece through rectifying elements and are independently connected to said light-receiving condition discriminator.

8. An electronic timepiece according to claim 1, wherein a light-receiving signal generator is arranged between said plurality of light-receiving elements and said light-receiving condition discriminator, said light-receiving signal generator including a light amount detector for detecting an amount of light detected by one light-receiving element and a selector for time-divisionally connecting said light amount detector to said plurality of light-receiving elements.

9. An electronic timepiece adapted to operate in first and second alternative modes of operation, comprising:

a housing;

at least three light-receiving elements entirely disposed interiorly of the housing for receiving external light;

a light condition discriminator entirely disposed interiorly of the housing and operably connected to the light-receiving elements for discriminating between a light-receiving condition of at least one light-receiving element and a no-light receiving condition of at least two light-receiving elements and for generating a signal when the at least two elements are in a no-light receiving condition; and circuit means entirely disposed interiorly of the housing and operably connected with the discriminator for changing the operating mode of the timepiece from the first mode of operation to the second mode of operation when the discriminator generates the signal;

whereby the operating mode of the timepiece can be changed from the exterior of the housing by changing the light-receiving condition of at least one light-receiving element and without physically penetrating the housing.

10. An electronic timepiece according to claim 9 including means for temporarily covering at least one of the light-receiving elements to place it in the no-light receiving condition and thereby effect the change of the operating mode of the timepiece.

11. An electronic timepiece according to claim 9 including at least three light receiving elements, and wherein the means for temporarily covering at least one of the light-receiving elements causes a central one of the at least three light-receiving elements to be exposed to light and causes light-receiving elements on either side of the central light-receiving element to be covered.

12. A timepiece according to claim 9 wherein the first mode of operation is a timekeeping mode of operation and the second mode of operation is a time-correction mode of operation of the timepiece.

* * * * *